United States Patent [19]

Richmond et al.

[11] Patent Number: 4,665,582

[45] Date of Patent: May 19, 1987

[54] LIGHTWEIGHT BATTERY POWERED SUCTION BROOM

[75] Inventors: Clark S. Richmond, Normal; Joyce K. Thomas; Samuel E. Hohulin, both of Lexington, all of Ill.

[73] Assignee: National Union Electric Corp., Bloomington, Ill.

[21] Appl. No.: 704,567

[22] Filed: Feb. 22, 1985

[51] Int. Cl.[4] ..... A47L 5/28

[52] U.S. Cl. ..... 15/344; 15/351; 15/352; 15/415 R; 15/420

[58] Field of Search ..... 15/344, 350, 351, 359, 15/339, 415, 352, 420

[56] References Cited

U.S. PATENT DOCUMENTS

| | | | |
|---|---|---|---|
| 1,759,947 | 5/1930 | Lee | 15/351 X |
| 1,768,617 | 7/1930 | Lee | 15/351 |
| 1,826,798 | 10/1931 | Lee | 15/351 |
| 2,564,339 | 8/1951 | Nerheim | 15/344 |
| 2,626,418 | 1/1953 | Kelly et al. | 15/344 X |
| 2,658,228 | 11/1953 | Meyerhoefer | 15/415 X |
| 2,954,576 | 10/1960 | Helm | 15/350 X |
| 3,273,194 | 9/1966 | Jepson et al. | 15/350 X |
| 3,512,208 | 5/1970 | Spencer | 15/420 X |
| 3,758,914 | 9/1973 | Nupp et al. | 15/344 X |
| 4,558,484 | 12/1985 | Groth | 15/353 X |

FOREIGN PATENT DOCUMENTS

| | | | |
|---|---|---|---|
| 1453075 | 2/1969 | Fed. Rep. of Germany | 15/350 |
| 3228491 | 2/1984 | Fed. Rep. of Germany | 15/344 |
| 990065 | 4/1965 | United Kingdom | 15/344 |

*Primary Examiner*—Chris K. Moore

*Attorney, Agent, or Firm*—Alfred E. Miller

[57] ABSTRACT

A lightweight broom having a rechargeable battery powered vacuum pump and a mounting assembly for pivotally mounting a nozzle. The mounting assembly and power assembly are spaced apart on a frame carrying both assemblies, and a filter bag arrangement is removably received therebetween. The filter bag arrangement includes a canister adapted to removably fit on a frame between the mounting assembly and the power assembly.

19 Claims, 45 Drawing Figures

FIG.24
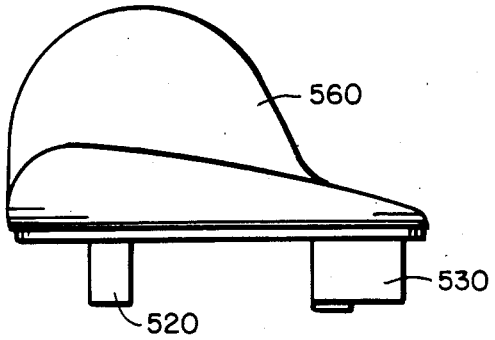
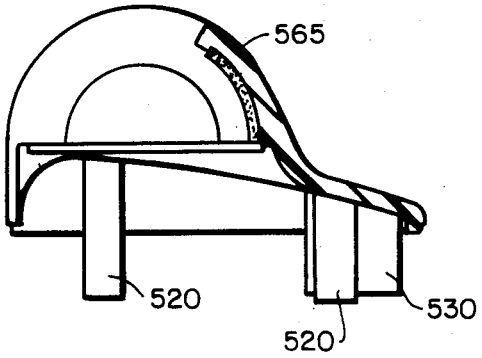
FIG.25

LIGHTWEIGHT BATTERY POWERED SUCTION BROOM

This invention relates to vacuum cleaners, and more in particular a vacuum cleaner apparatus especially adapted for hand held, portable operation.

The invention is directed to the provision of a portable vacuum cleaner that is readily and economically fabricated, and easy and reliable to use, and that may be recharged in a simple manner.

Briefly stated, in accordance with the invention, a portable vacuum cleaner is comprised of a frame encorporating a mounting assembly for pivotally mounting a nozzle assembly, and a power assembly including a vacuum pump. The mounting assembly and the power assembly are spaced apart on the frame, so that a filter bag assembly may be removably received therebetween.

The nozzle assembly is comprised of lower and upper nozzle sections adapted to be assembled on opposite sides of a hollow mounting cylinder of the mounting assembly, in order to permit limited pivotal movement of the nozzle assembly. Forward and rear wheels are provided in the lower nozzle section. A recess extends transversly in the bottom of the lower nozzle section, terminating in a central aperture communicating with the hollow mounting cylinder, in order to direct air from the nozzle assembly to the vacuum pump.

The filter bag assembly is comprised of a canister adapted to be removable fit on the frame between the mounting assembly and the power assembly. The canister is pivoted at the mounting assembly and held by a latch at the power assembly. A longitudinal groove in the bottom of the canister receives a bar-shaped element of the frame, both to inhibit lateral displacement of the canister and to join the power assembly to the nozzle assembly, thus enabling a pleasing appearance of the structure. The canister removably receives a filter bag.

The power assembly incorporates a battery and recharging circuit, so that when the mounting projection of a mounting base is received in a recess of the power assembly, for storage of the vacuum cleaner, an electrical interconnection enables recharging of the operating battery.

BRIEF FIGURE DESCRIPTION

In order that the invention may be more clearly understood, it will now be disclosed in greater detail with refernce to the accompanying drawings, wherein:

FIG. 24 is an end view of the upper nozzle section;

FIG. 25 is a transverse cross sectional view of the upper nozzle section taken along the lines 25—25 of FIG. 21;

Figure 45:
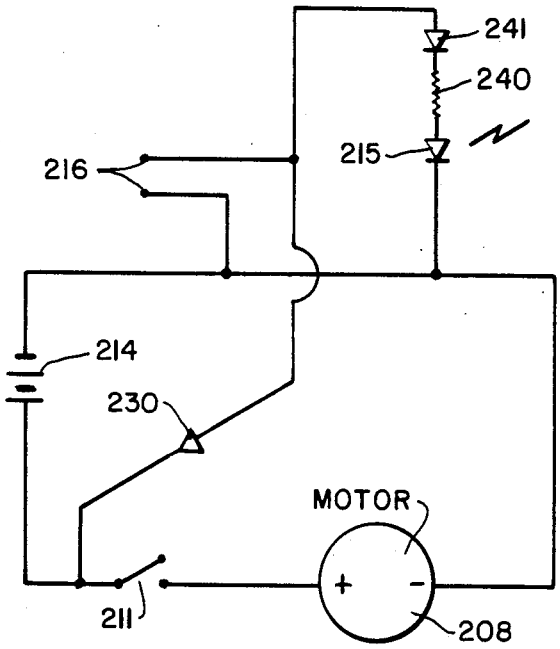
Figure 44:
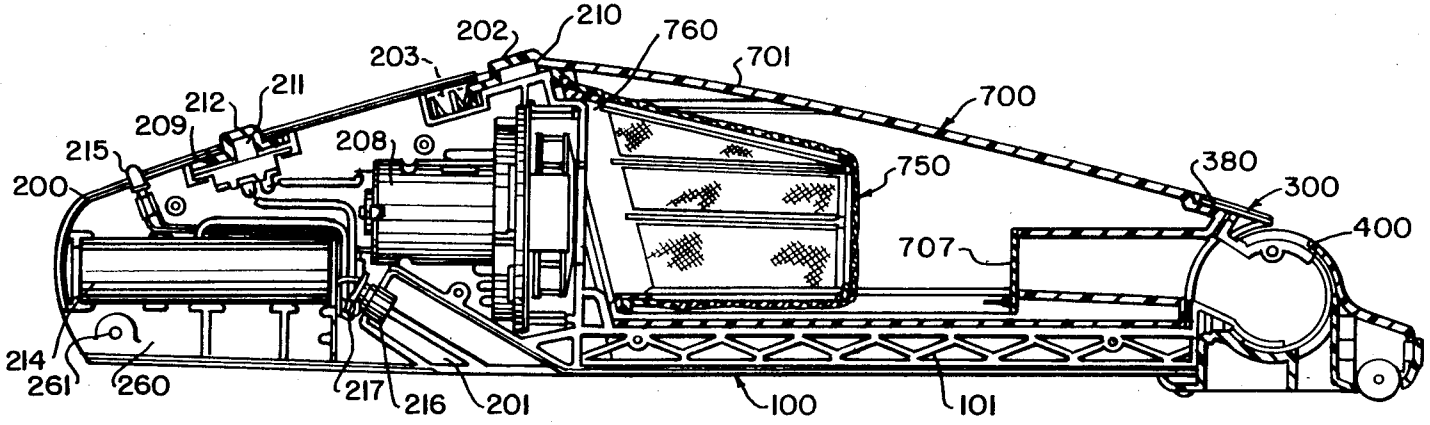

FIG. 44 a longitudinal cross sectional view of the assembled vacuum cleaner; and FIG. 45 is a circuit diagram of the vacuum cleaner.

DETAILED DISCLOSURE OF THE INVENTION

Referring now to the drawings, and more in particular to FIGS. 1–6, therein is illustrated a vacuum cleaner system in accordance with the invention. The assembly is comprised of a frame 100 having a power assembly 200 on one end and a mounting assembly 300 on its other end for pivotally holding a nozzle assembly 400 comprised of an upper nozzle section 500 and a lower nozzle section 600. A filter assembly 7000 is adapted to be removably snapped to the frame, between the mounting assembly 300 and the power assembly 200, a filter bag 750 being mounted in the filter assembly 700 and being held in shape therein by a bag support 760. A handle 800 is affixed to the frame 100, for example in the power assembly 200 thereof. A charging mount 900, for example adapted to be mounted to a wall 980, has a mounting projection 901 adapted to be received in a recess 201 of the power assembly, thereby to enable the vacuum cleaner assembly to be hung on a wall and simultaneously charged. As will be discussed, suitable electrical connections are provided in the mounting projection 901 and in power assembly 200 in order to enable charging of the batteries of the power assembly when it is not in use.

Figure 1:
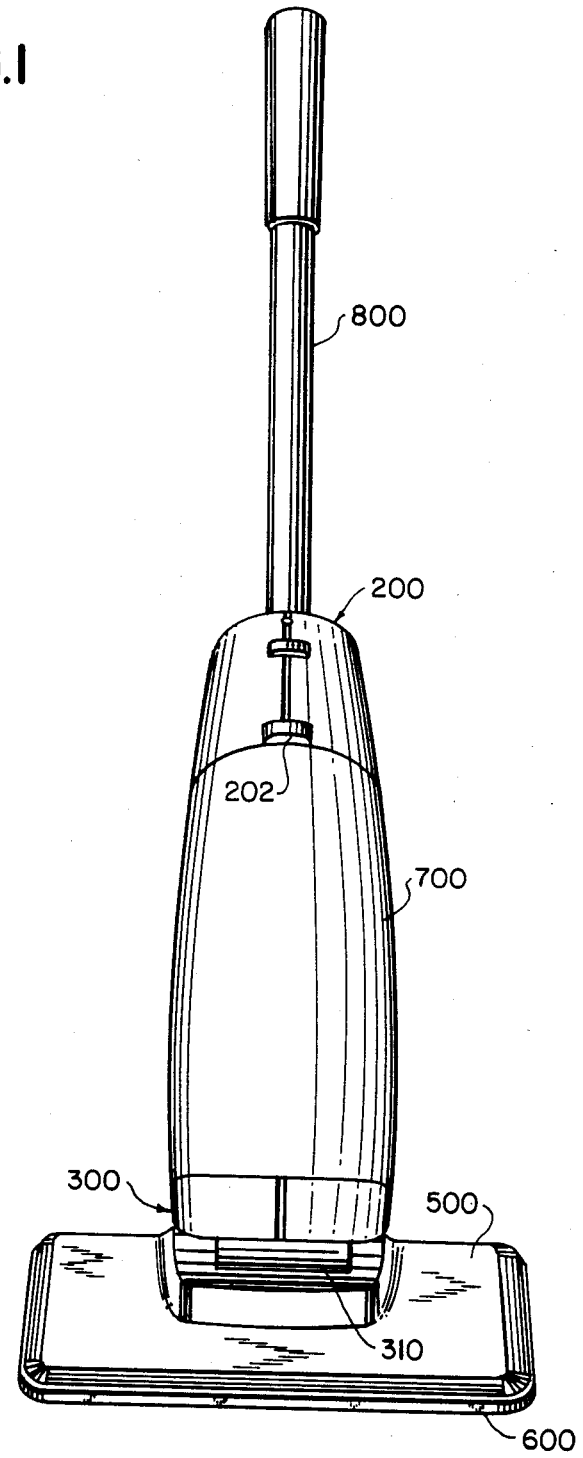
FIG. 1 is a front view of the vacuum cleaner of the invention.
Figure 2:
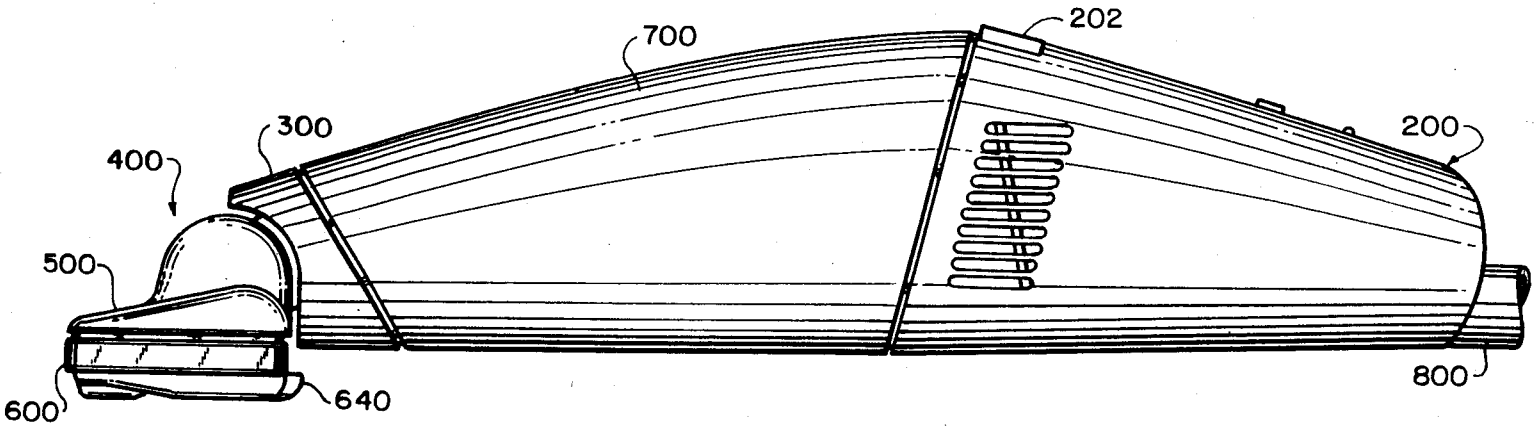
FIG. 2 is an enlarged side view of a portion of the vacuum cleaner of FIG. 1.
Figure 3:
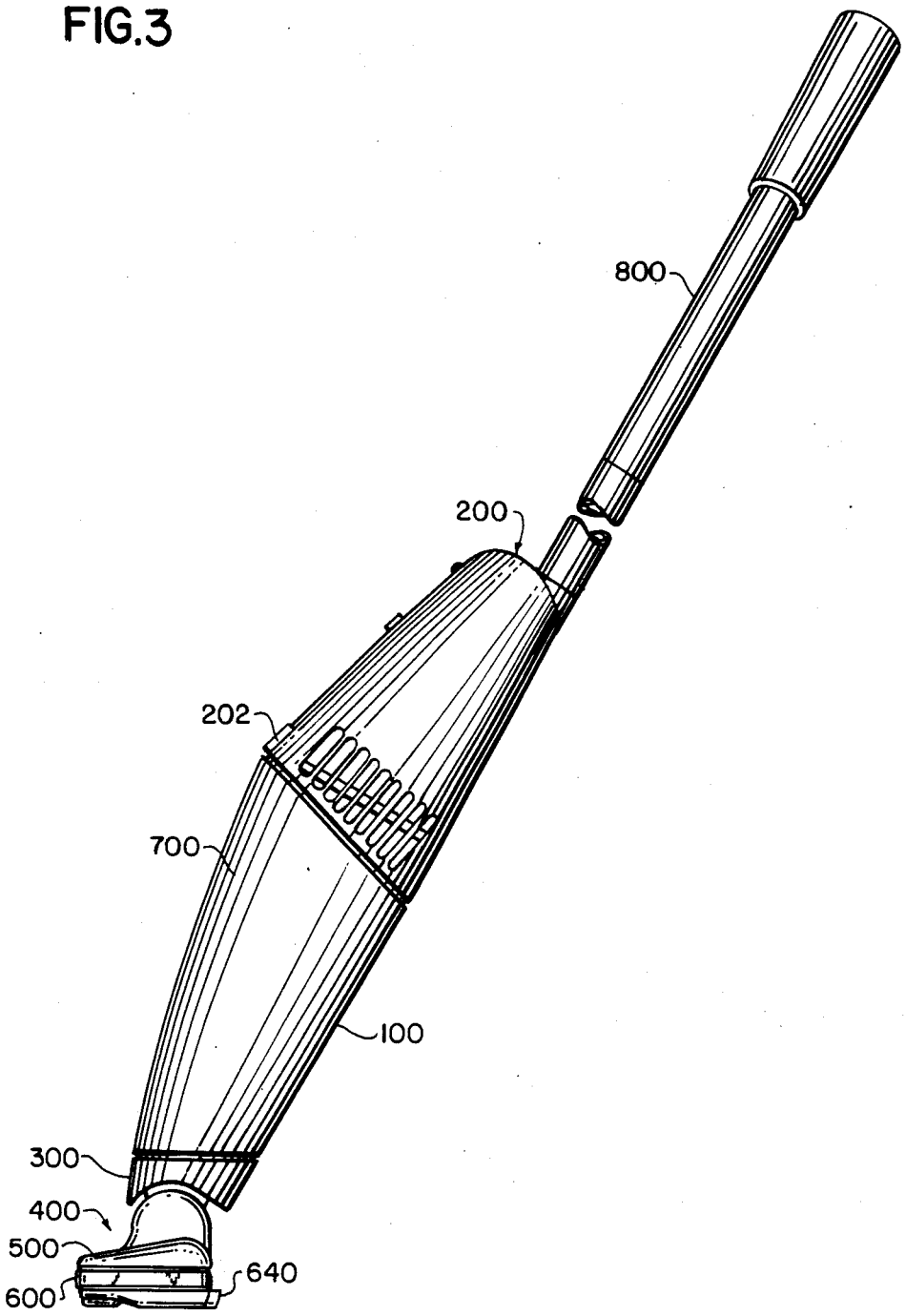
FIG. 3 is a side view of the vacuum cleaner of FIG. 1.
Figure 4:
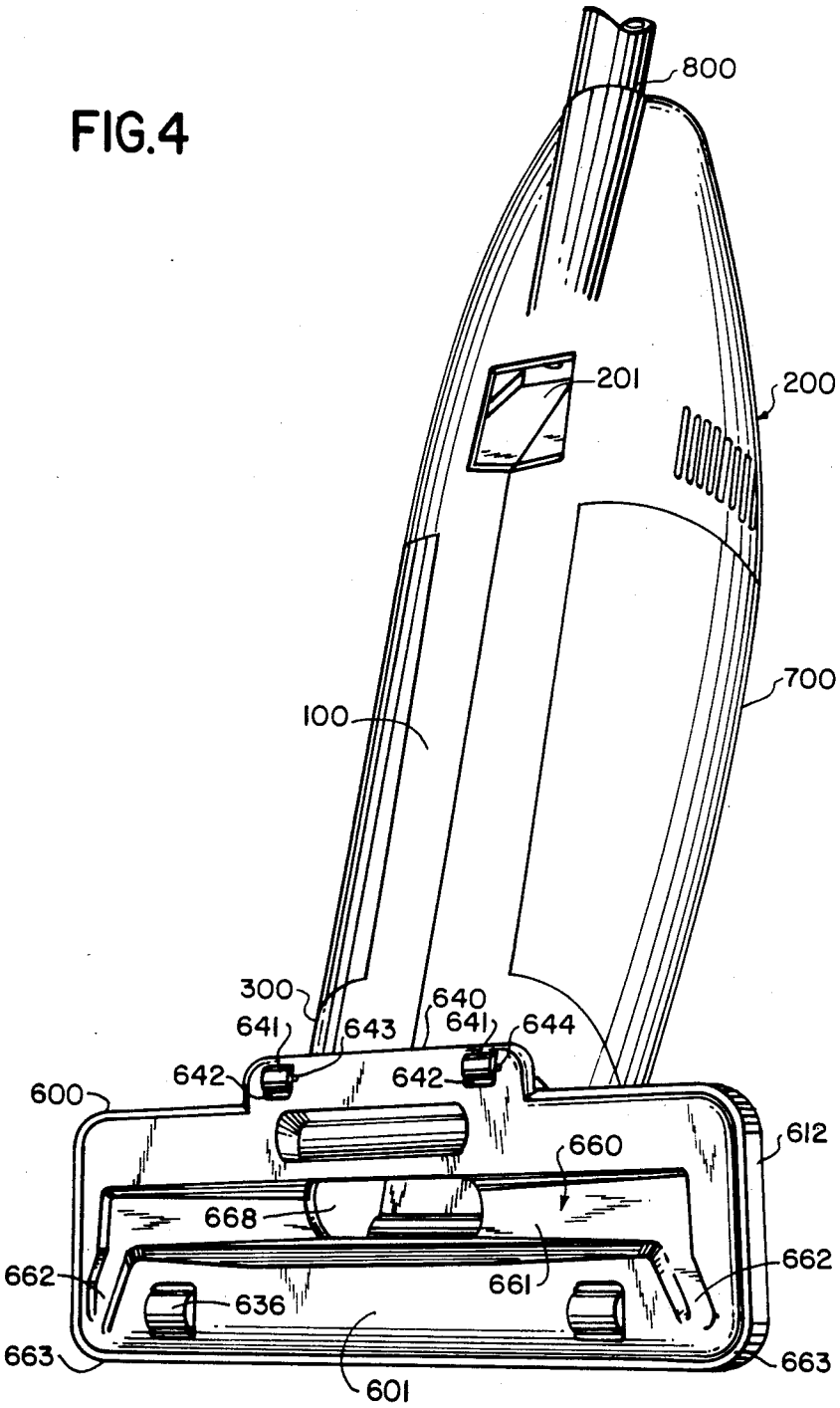
FIG. 4 is an enlarged bottom view of a portion of the vacuum cleaner of FIG. 1.
Figure 5:
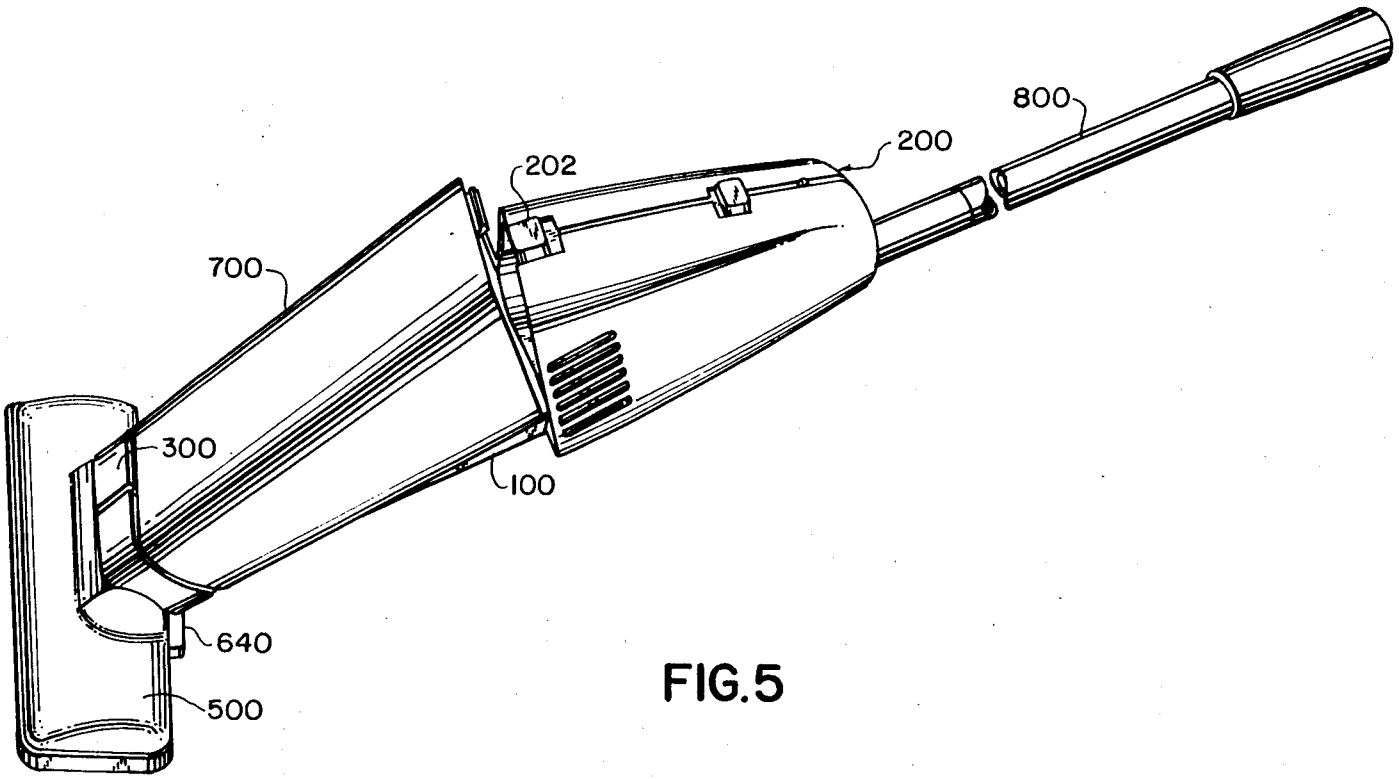
FIG. 5 is a top perspective view of the vacuum cleaner of FIG. 1, with the filter assembly canister partially removed.
Figure 6:
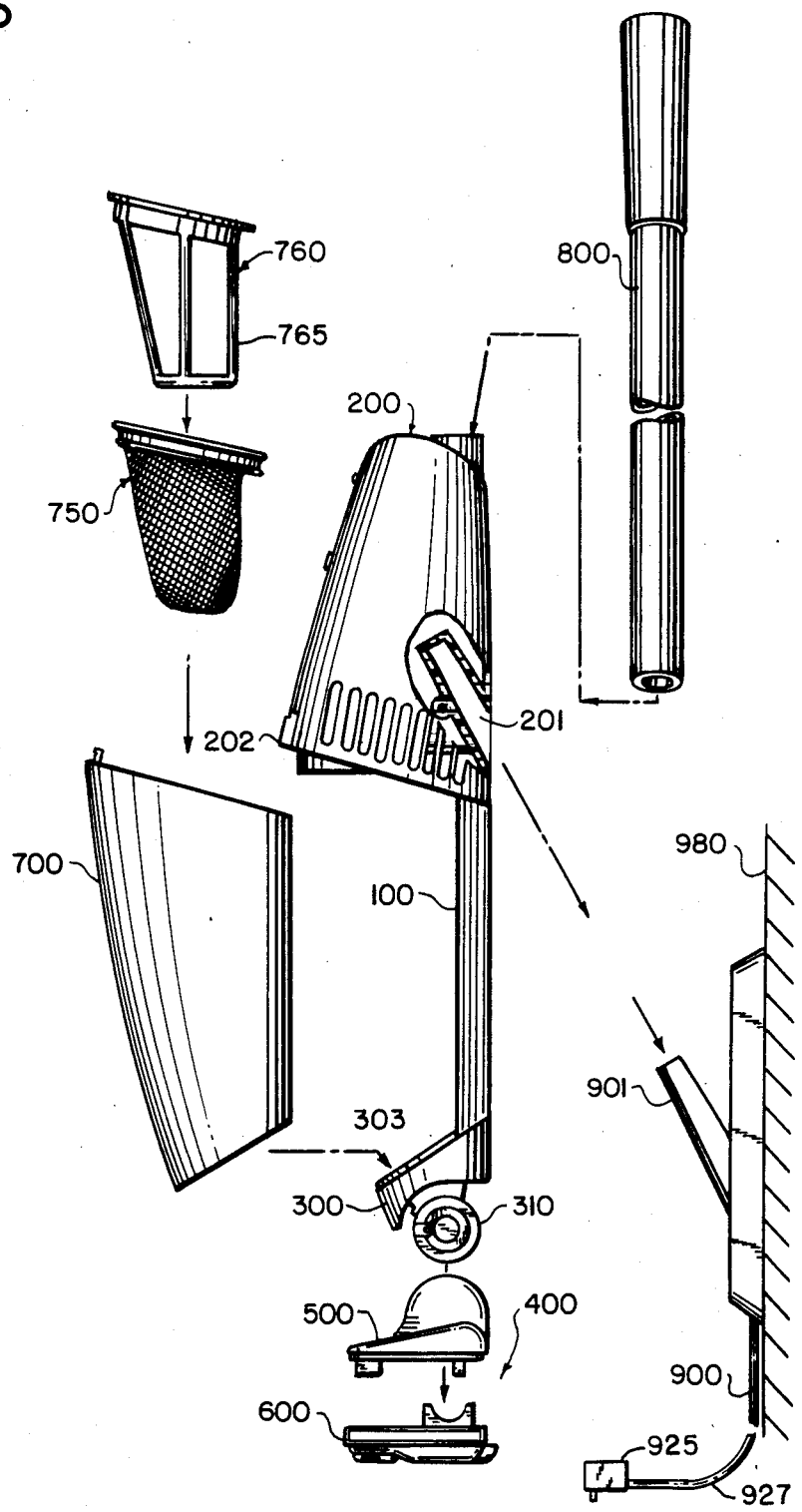
FIG. 6 is an exploded view of the vacuum cleaner of FIG. 1.

As is readily apparent in the exploded diagram of FIG. 6 and the cross sectional view of FIG. 44, the power assembly, which includes a vacuum pump 200 is adapted to draw air through the nozzle assembly 400, thence through the mounting assembly 300 into the filter assembly 700. The air is drawn through the filter bag of the filter assembly, exiting into the vacuum pump 210 in the power assemby. Dirt drawn through the vacuum cleaner nozzle will hence collect on the outside of the filter bag and in the filter assembly canister. In order to discard such dirt, the filter assembly 700 may be readily disassembled from the frame. For example, as illustrated in the FIG. 5, upon depression (i.e. drawing toword the rear) of a latch button 202, the rear of the filter asesmbly 700 may be pivoted away from the frame, the forward end thereof being formed to pivot in the mounting assembly 300.

As employed hereafter in this disclosure, the terms "rearwardly" or "rear" side, refer to the direction toword the handle, whereas the "forward" direction refers to the direction towards the nozzle assembly.

The frame of the vacuum cleaner in accordance with the invention is illustrated in more detail in FIGS. 7–11. The frame is preferably molded from a high impact plastic of conventional material, and may be formed in two longitudinal halves adapted to be held together by any conventional means, such as screws.

The frame 100 may be comprised of a generally bar-shaped support 101. The mounting assembly 300 is comprised of a hollow base 301 affixed to one end of the bar-shaped support 101, the rearward side 302 of the base 301 being inclined to the longitudinal direction of the bar-shaped support 101. For example, an angle A of about 30 degrees may be provided between the plane of the side 302 of the base and the perpendicular to the longitudinal direction of the bar-shaped support 101.

The upper surface 102 of the bar-shaped support 101 is generally planar, the base 301 of the mounting assembly defining a rearwardly extending rim 303 about its periphery and terminating at the bar-shaped support 101 in the plane of the surface 102. As will be apparent in the following discussion of the filter assembly, the rim 303 of the mounting assembly serves to hold and provide a pivot surface for the filter assembly, the filter assembly being formed to laterally surround the bar-shaped support 101 to laterally support the filter assembly in an esthetic manner. As employed herein the term "upper" refers to the direction away from the side of the vacuum cleaner adapted to be adjacent a mounting wall when the vacuum cleaner is held on the wall mounted charging mount 900.

A hollow pivot cylinder 310 is affixed to the front side of the base 301 by a forwardly extending mounting stub 311. The axis of the pivot cylinder extends transversely of the vacuum cleaner, i.e., normal to a vertical longitudinal plane extending through the vacuum cleaner, the term "vertical" referring of course to a plane extending in the upward direction as above defined. The pivot cylinder has end walls 320,321 joined by an upper partial circumferential wall 322 and a lower partial cicumferential wall 323. The forward cicumferential gap 324 between the circumferential walls 322 and 323 defines a passageway for air, from the forward end of the mounting assembly through the rear end thereof. The rear ends of the walls 320 and 321 and partial circumferential walls 322 and 323 of the pivot cylinder are rearwardly extended through the stub 311, to laterally enclose the defined passageway laterally. An axially extending annular projection 340 is provided depending from the outside of each end wall 320,321, for serving as a labyrinth seal with the nozzle assembly, and to provide a pivoting surface, as will be discussed.

In order to hold the longitudinal halves of the frame assembly together, suitable screw holes may be provided therein such as the screw hole 350 of the pivot cylinder, the screw holes 110 on the bar shaped element, and the screwholes 290 in the power assembly, each adapted to receive a self-tapping screw (not shown).

The pivot cylinder 310 is adapted to pivotally mount the nozzle assembly to the vacuum cleaner, and sealingly direct air from the nozzle assembly to the filter assembly. The nozzle assembly is illustrated in detail in FIGS. 12–25, FIGS. 12–19 illustrating the lower nozzle section and FIGS. 20–25 illustrating the upper nozzle section.

As illustrated in FIGS. 12–19, the lower nozzle section is comprised of a moulded plastic shell 610 having a lower surface 611 and an upwardly extending rim 612 depending therefrom. As illustrated in FIGS. 20–25, the upper nozzle section is comprised of a moulded plastic shell 510 having an upper surface 511 and a downwardly extending rim 512 depending thereform, the rim 512 of the upper nozzle section being adapted to vertically abut the top of the rim 612 of the lower nozzle section. The upper and lower nozzle sections are adapted to be held together by any conventional means, such as screws. For this purpose, downwardly extending studs 520 of the upper nozzle section are adapted to abut the top of the bottom surface of the lower nozzle section adjacent recessed holes 620 of the lower nozzle section when the upper and lower nozzle sections are assembled together, so that suitable screws (not shown) extending through the recessed holes 620 may be threaded into the studs 520.

The shells which form the upper and lower nozzle sections are generally rectangular, with the longer dimension thereof extending transversly of the vacuum cleaner, i.e., in the direction of the axis of the pivot cylinder 320 of the mounting assembly 300.

Figure 14:
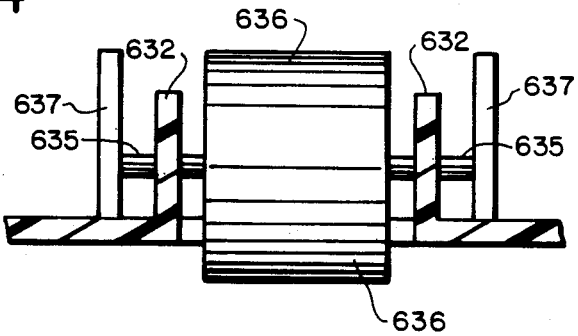
FIG. 14 is an enlarged cross sectional view of a forward wheel assembly taken along the lines 14—14 of FIG. 12.
Figure 15:
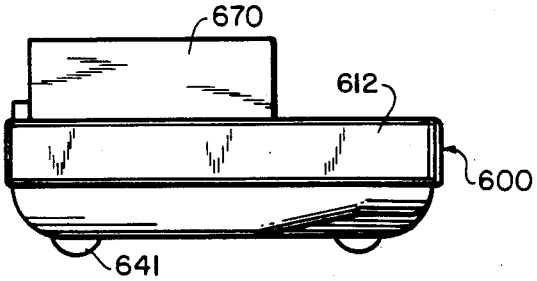
FIG. 15 is a side view of the lower nozzle section in the direction indicated by the lines 15—15 of FIG. 12.

The molding shell 610 has a pair of generally rectangular apertures 630 extending therethrough adjacent its forward edge 632, the apertures being symmetrically located on opposite sides of the center of the bottom (i.e. the axial center of the pivot cylinder 310 of the mounting assembly 300, when the nozzle is assembled thereto). As seen in FIG. 14, a pair of short walls 632 are provided extending upwardly adjacent the sides of each of the recesses 630, the upper surface of the walls 632 each having a transversly extending groove for receiving the shaft 635 of a forward wheel 636, the forward wheels having a diameter to extend through the apertures 630 to serve as floor engaging wheels. Axial displacement of the forward wheels is prevented by projections 637 extending upwardly from the bottom of the bottom surface 610, to axially abut the shaft 635 at each end. The shaft 635 is vertically retained in the grooves in the walls 632 by downwardly extending short walls 530 of the upper nozzle section (FIGS. 20–25), the bottom end of the short walls 530 abutting the tops of the short walls 632 of the lower nozzle section.

A generally rectangular rear extension 640 is provided on the lower nozzle section for receiving the rear roller wheels 641. The bottom surface of the rear extension 640 is generally alined with the bottom 610. The rear extension 640 has a pair of rectangular recesses 642 extending upwardly from its bottom surface, on opposite sides of the center of the lower nozzle section, the recesses (which preferably have closed tops) receiving the rear roller wheels 641. The shafts 643 of the roller wheels 641 extend into side recesses 644 of the recess 642, the recesses 644 being peened over or otherwise deformed so that the shafts 643 may be inserted thereinto and held during use of the vacuum cleaner.

Figure 16:
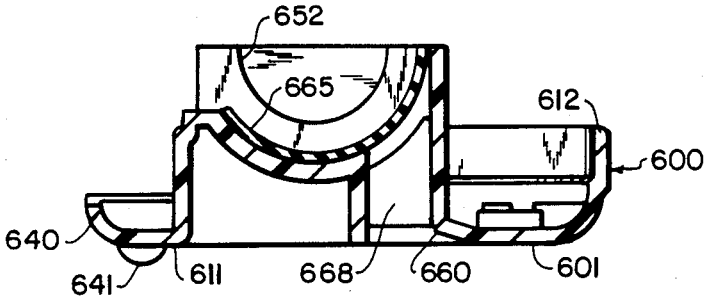
FIG. 16 is a transverse cross sectional view of the lower nozzle section taken along the lines 16—16 of FIG. 12.
Figure 17:
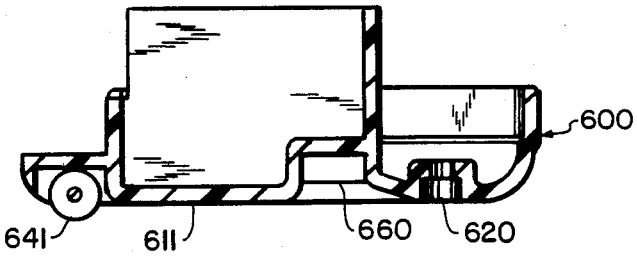
FIG. 17 is a transverse cross sectional view of the lower nozzle section taken along the lines 17—17 of FIG. 12.
Figure 18:
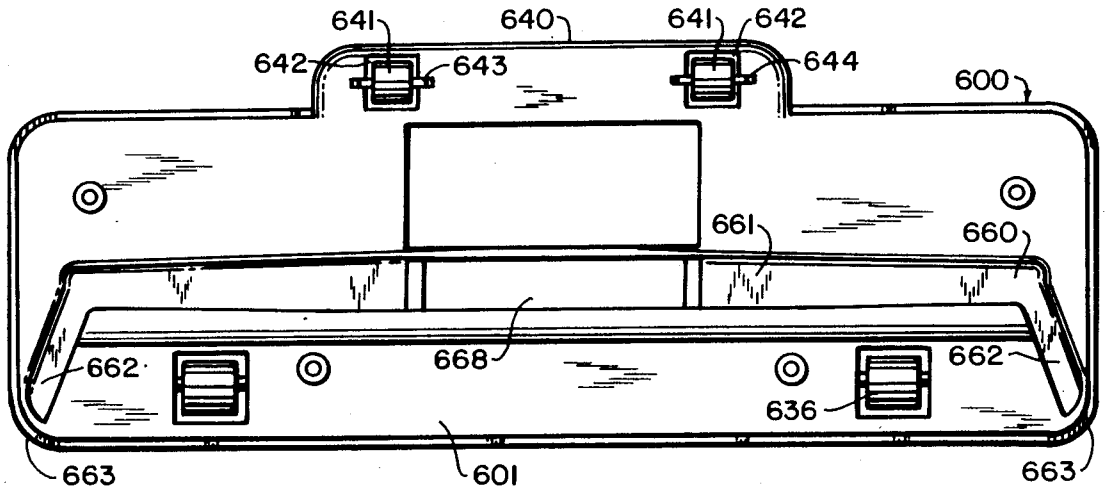
FIG. 18 is a bottom view of the lower nozzle section.
Figure 19:
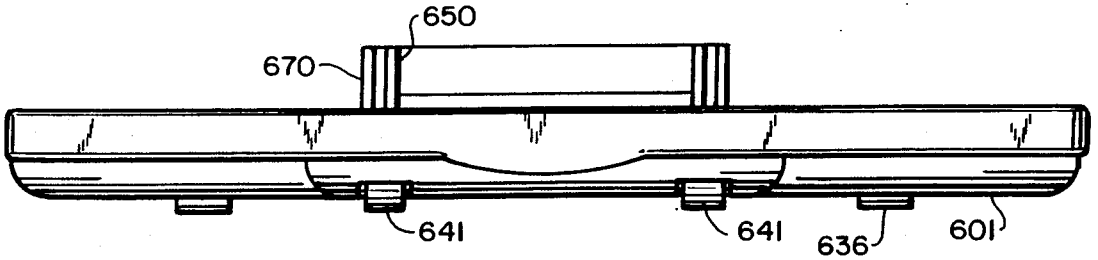
FIG. 19 is a rear view of the lower nozzle section.
Figure 20:
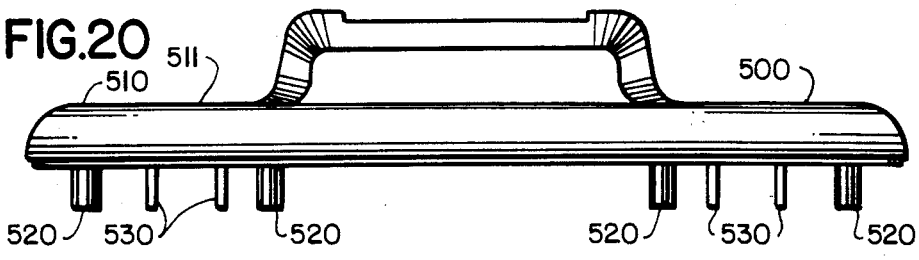
FIG. 20 is a front view of the upper nozzle section of the vacuum cleaner.
Figure 21:
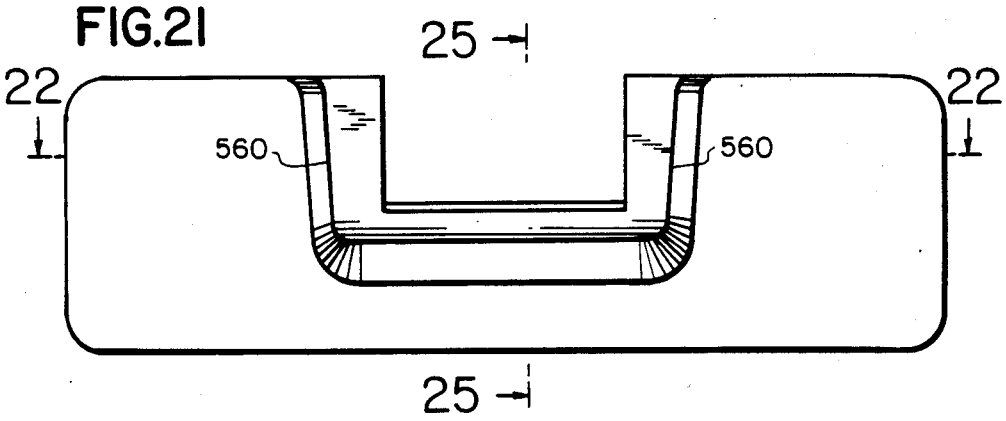
FIG. 21 is a top view of the upper nozzle section.
Figure 22:
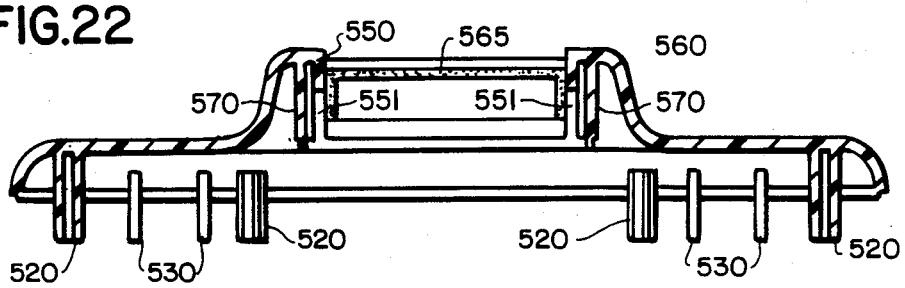
FIG. 22 is a longitudinal cross sectional view of the upper nozzle section taken along the lines 22—22 of FIG. 21.
Figure 23:
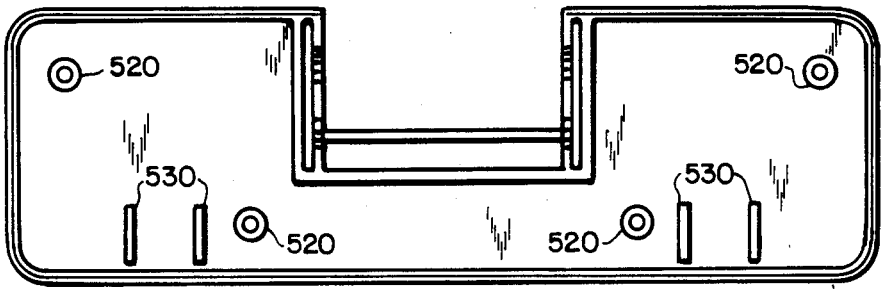
FIG. 23 is a bottom view of the upper nozzle section.

In order to pivotally mount the nozzle on the pivot cylinder 310 of the mounting assembly (FIGS. 7–11), a pair of walls 650 are provided extending upwardly from the bottom 610 of the lower nozzle section, and symmetrically on opposite sides of the center thereof and adjacent the rear 651 thereof, the walls 650 extending above the top of the rim 612 and having semicircular recesses 652 in their upper surfaces, substantially equal in diameter to the diameter of the annular projections 340 of the pivot cylinder 310 of the mounting assembly 300 of FIGS. 7–11. These walls 650 are spaced apart a distance so that when the nozzle is assembled on the pivot cylinder, the circumferences of the annular projections 340 engage the semicircular recesses 652. Corresponding downwardly extending walls 550 are provided on the upper nozzle section (FIGS. 20–25), the walls 550 having semicircular recesses 551 in their lower edges for engaging the circumferences of the annular projections 340 of the pivot cylinder. The bottoms of the walls 550 are positioned to engage the top surfaces of the walls 650, so that the semicircular recesses of the walls 650 and 550 substantially completely surround the annular projection 340 of the pivot cylinder to hold the nozzle assembly and mounting assembly together and to permit limited pivoting movement of the nozzle assembly. Since the walls 650 of the lower nozzle portion extend above the lower nozzle section as seen in FIG. 16, the center of the upper nozzle section has a raised boss 560, from which the walls 550 extend downwardly. The rear of the boss 560 has a recess 551 cut out therefrom to enable the stub 311 of the pivot cylinder to pass therethrough, and to permit the pivotal movement of the nozzle assembly. On assembly of the nozzle assembly to the pivot cylinder, the upper nozzle section is first assembled onto the pivot cylinder, after which the bottom nozzle section is affixed to the upper nozzle section. Since the annular projections 340 extend to engage the semicircular recesses of the nozzle sections, the nozzle cannot be removed from the mounting assembly without first separating the upper and lower nozzle sections.

Referring again to FIGS. 12–19, the lower surface 601 of the bottom nozzle section has an upwardly extending recess 660, the recess 660 having a central portion 661 extending transversely of the vacuum cleaner and terminating at and portions 662 extending to the front corners 663 of the lower nozzle section. An aperture 668 extends through the bottom of the nozzle section, to enable communication between recess 660 and the passageway 324 through the pivot cylinder 310. Since the power assembly of the vacuum cleaner is drawing air from the nozzle through the filter, it is apparent that the recess 660 forms a channel creating a flow path from the front corners of the nozzle. This channel enhances the ability of the nozzle to pick up dirt at the corners of the nozzle, it being apparent of course that, since the recess 660 extends across the entire bottom nozzle section, dirt is picked up by the nozzle throughout its width, as the nozzle is moved across the surface to be cleaned.

In order to inhibit the flow of air into the pivot cylinder from the other portions of the nozzle, the lower nozzle portion is further provided with walls 670 spaced from the outside of the walls 650, the upper nozzle section being provided with corresponding downwardly extending walls 570 adapted to abut the walls 670. The walls 570 and 670 hence inhibit the flow of air axially to the pivot cylinder from the interior of the nozzle. The lower and upper nozzle sections are preferably provided with seals 670 and 570 respectably for engaging the pivot cylinder, to inhibit the escape of air through the rotating pivot joint. For example, the lower and upper nozzle sections may be provided with suitably shaped surfaces for holding seals 665,565 to engage the end portions 320,321 of the pivot cylinder as well as transversely extending seal portions 666 positioned to abut the arcuate wall portions 323 and 322 respectively of the pivot cylinder.

Figure 7:
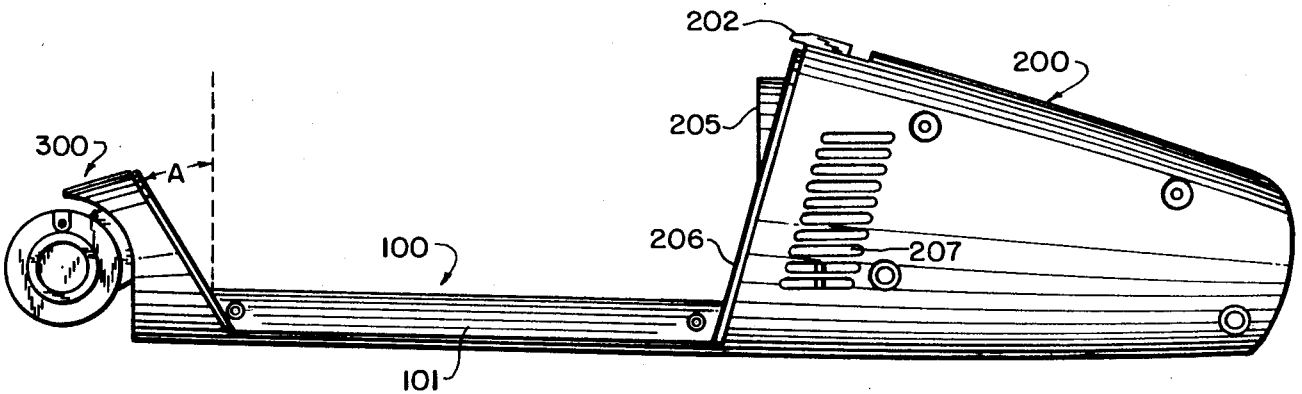
FIG. 7 is a side view of the frame of the vacuum cleaner of FIG. 1.
Figure 8:
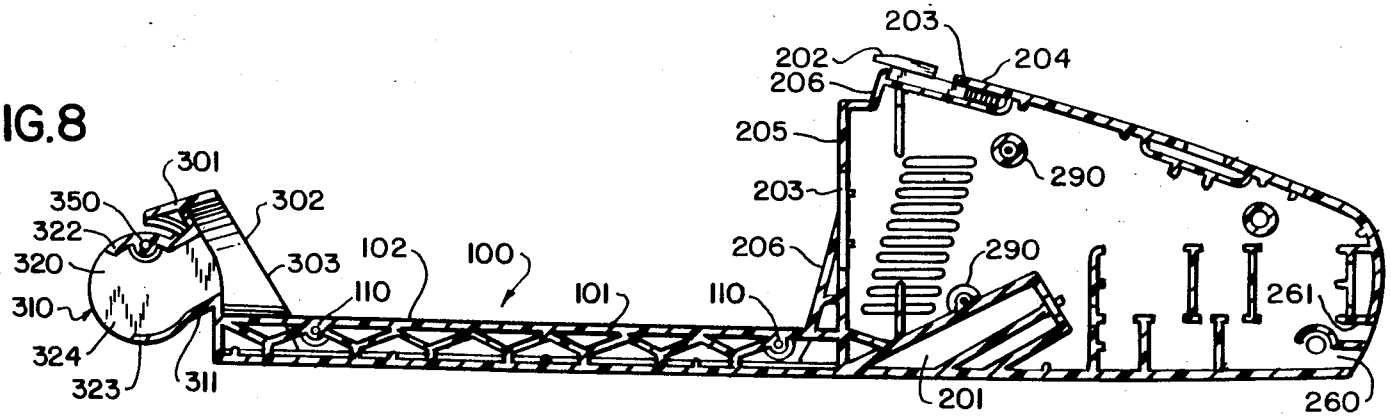
FIG. 8 is a longitudinal cross sectional view of the housing of the frame.
Figure 9:
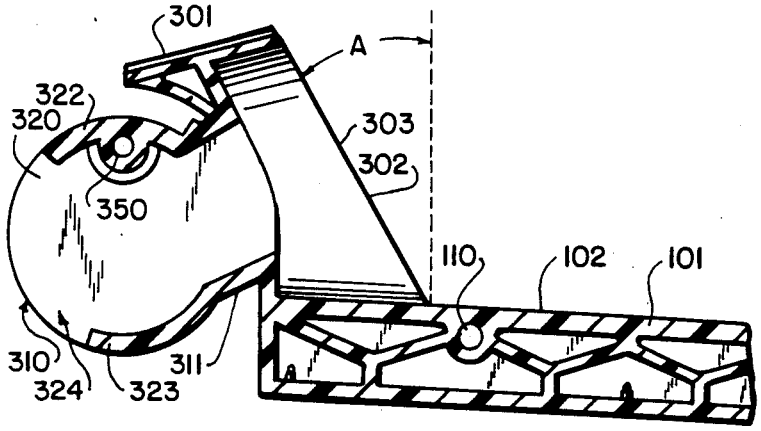
FIG. 9 is an enlarged longitudinal view of a portion of the forward end or mounting assembly of the frame housing.
Figure 10:
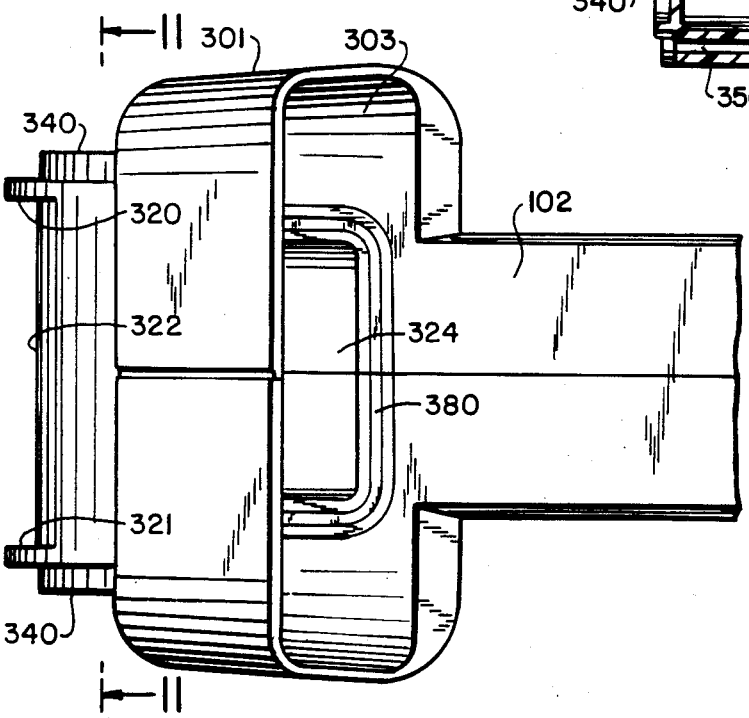
FIG. 10 is a top view of the portion of the frame housing illustrated in FIG. 9.
Figure 11:
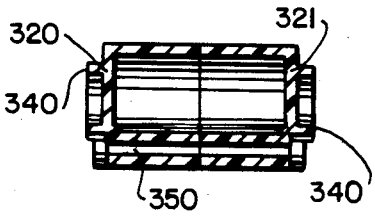
FIG. 11 is a transverse cross sectional view taken along the lines 11—11 of FIG. 10.
Figure 12:
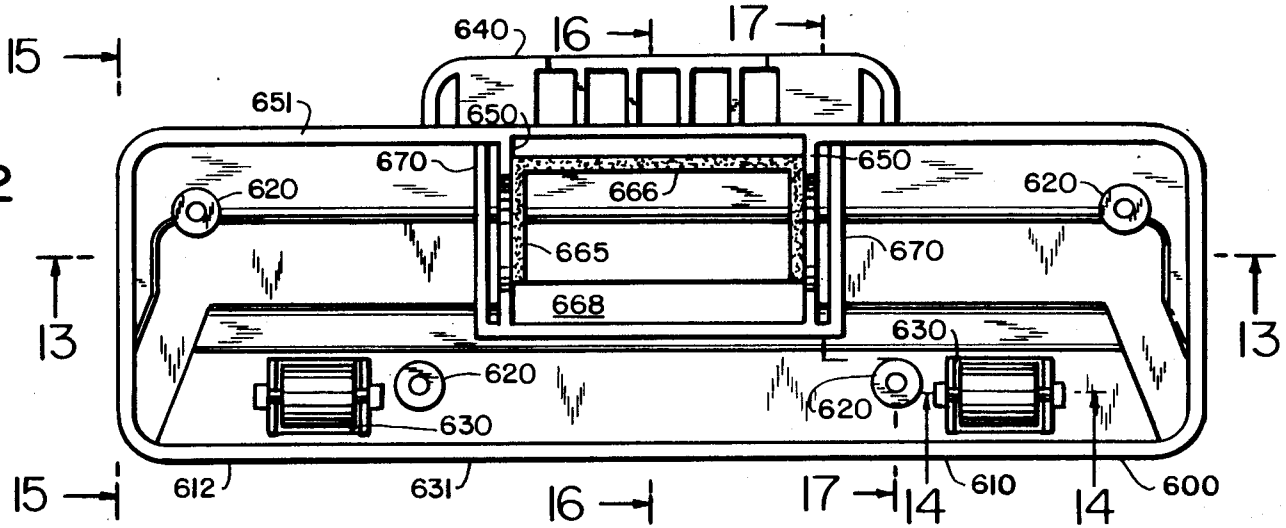
FIG. 12 is a top view of the lower nozzle section of the vacuum cleaner.
Figure 13:
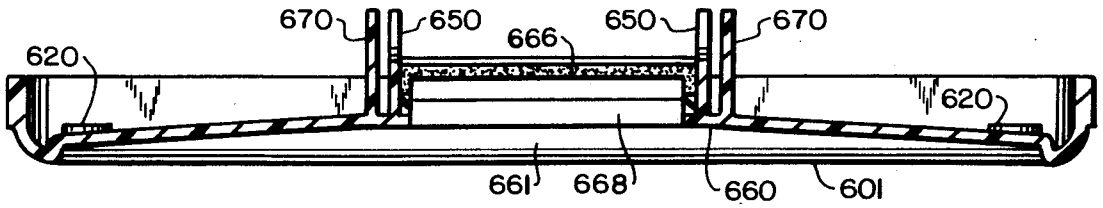
FIG. 13 is a cross sectional view of the lower nozzle section taken along the lines 13—13 of FIG. 12.

Referring now to FIGS. 7, 8 and 44, the power assembly 200 is comprised of a housing 204 affixed to the rear of the bar-shaped support 101, for enclosing the vacuum pump and electrical control circuits. The housing 204 has an upwardly extending central front wall 205 with a central hole 203 for receiving air from the filter assembly. The wall 205 extends generally perpendicular to the plane of the top surface 102. The outer portions of the front of the housing 204 are defined by a wall 206 inclined to the plane of the top surface 102 and away from the mounting assembly to enable receiving the seal of the filter assembly as will be discussed later. The inner edge of the wall 206 is joined to the vertical wall 205.

Figure 41:
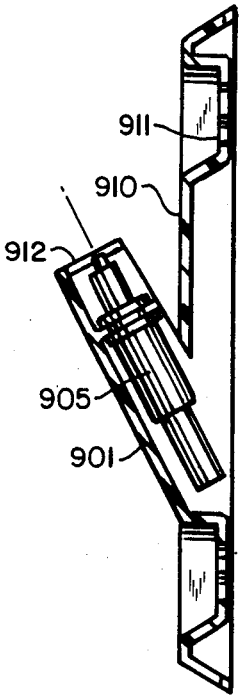
FIG. 41 is a vertical cross sectional view of the charging mount housing taken along the lines 41—41 of FIG. 40 and including the connector thereof.
Figure 42:
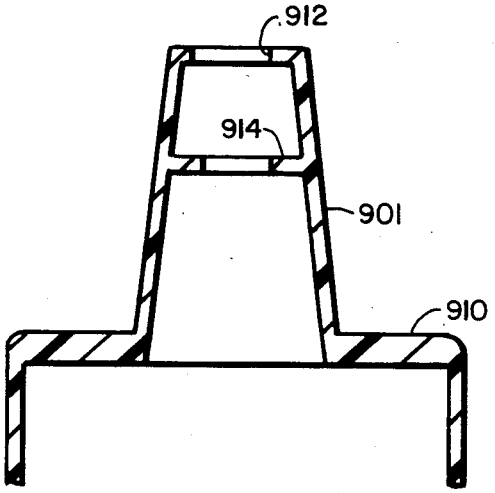
FIG. 42 is an enlarged cross sectional view of the charging mount housing taken along the lines 42—42 of FIG. 37.
Figure 43:
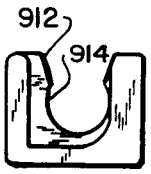
FIG. 43 is an upper end view of the mounting projection of the charging mount, taken in the direction of the lines 43—43 of FIG. 37.

A vacuum pump 210 is mounted immediately behind the wall 205, as illustrated in FIG. 44, for receiving air through the hole 203 and ejecting it through side ports 207 of the housing 204. A motor 208 drives the vacuum pump, and is mounted to the rear of the vacuum pump. An operating switch 209 is mounted in the housing 204, having an actuator 211. A plastic button 212 engages the actuator 211 and is slidably mounted in a suitable slot in the housing wall. Suitable support walls 213 are provided in the housing for holding a rechargeable battery 214, such as a Nicad battery. A charging lamp 215, such as a LED, is mounted on the top of the housing 204, to provide an indication of charging of the battery. A connector 216 is mounted in the the bottom of the recess 201, for engaging a mating connector 905 in the charging mount (FIG. 41). A circuit board 217 is mounted within the housing 204 at the rear of the connector 216, to carry further electrical components of the circut. Thus, as illustrated in FIG. 45, the switch 211 is connected to enable the application of current from the battery 214 to the motor 208. The charging circuit is comprised of a rectifier 230 connected between one of the terminals of the connector 216 and one terminal of the battery 214, the other terminal of the connector 216 being connected directly to the other terminal of the battery. It will be apparent that the voltage applied to the connector 216 is an AC voltage, and is stepped down by the wall socket transformer 925 connected to the charging mount, as illustrated in FIG. 6. The charging indicating lamp 215 is connected to the connector 216 by way of a dropping resister 240 and diode 241, for limiting the indicator current and blocking reverse voltage on the indicator lamp.

The filter assembly is illustrated in FIGS. 26–35 and 44. As illustrated, the filter assembly is comprised of a hollow canister 701 having a forward end 702 and a rear end 703. The forward end 702 is shaped to fit into the rim 303 of the mounting assembly, as illustrated in FIGS. 6 and 44, to abut the seal 380 surrounding the passage way 324 of the mounting assembly. The rear end 703 of the canister is inclined to the plane of the surface 102, so that it may sealingly engage the inclined forward end 206 of the power assembly. The canister further has a lontitudinally extending resess 704 in its bottom, to receive the frame 100.

The canister of the filter assembly is installed on the vacuum cleaner by inserting the forward end into the rim 303 of the mounting assembly, and then pivoting the rear of the canister downwardly until its inclined rear surface abuts the inclined forward surface 206 of the power assembly. In this position, the longitudianl recess 704 of the canister receives the frame 100, to inhibit any side wise movement of the canister with respect to the mounting assembly and power assembly. Further, as apparent in FIGS. 2–4, when the canister is thus installed, the bottom of the frame is flush with the bottom of the canister, to form a smooth esthetic appearance. The pivoting of the canister, during the assembly is illustrated in FIG. 5.

In order to hold the canister in position in the vacuum cleaner assembly, the catch 202 on the rear end of the top of the power assembly slidingly engages a lip 705 extending rearwardly from the top of the rear surface 703 of the canister. The catch 202 is urged forwardly by a spring 203 provided in a suitable resess in the power assembly housing 204, as illustrated in FIGS. 8 and 44. Consequently, manually urging the catch 202 enables release of the canister, so that it may be pivoted away from and removed from the vacuum cleaner. Since the forward end of the canister pivots in the mounting assembly, the inclined rear edge of the canister meets the inclined forward surface 206 of the power assembly at the position where the catch 202 engages the projection 705 of the canister, to lock the canister in place.

Figure 27:
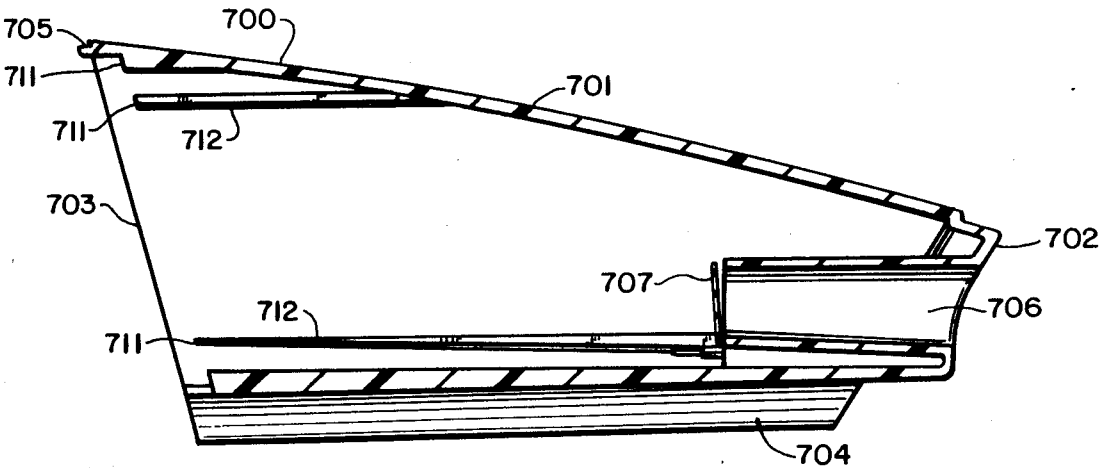
FIG. 27 is a longitudinal cross sectional view of the cannister of the filter assembly.
Figure 28:
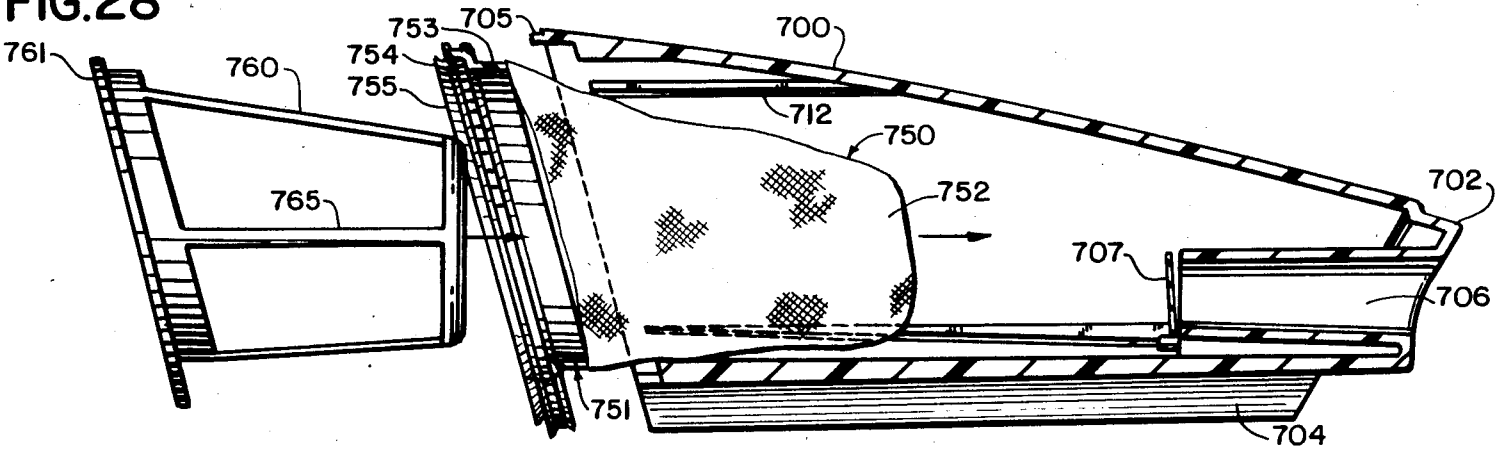
FIG. 28 is an exploded partially cross sectional view of the filter assembly.
Figure 29:
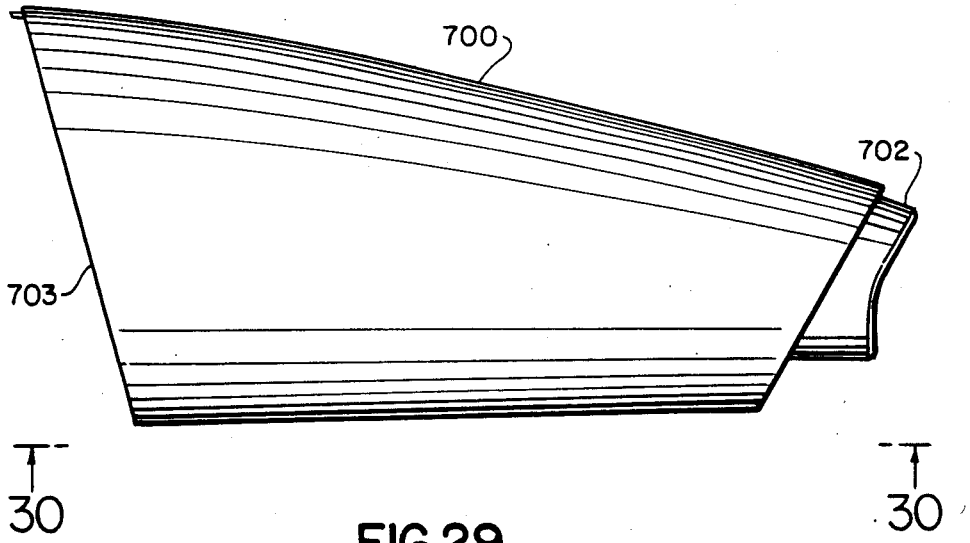
FIG. 29 is a side view of the canister.
Figure 30:
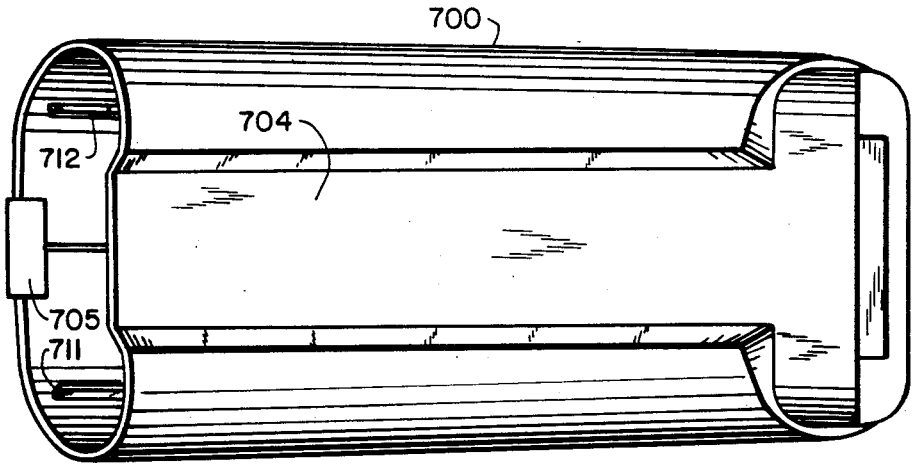
FIG. 30 is a bottom view of the canister.
Figure 31:
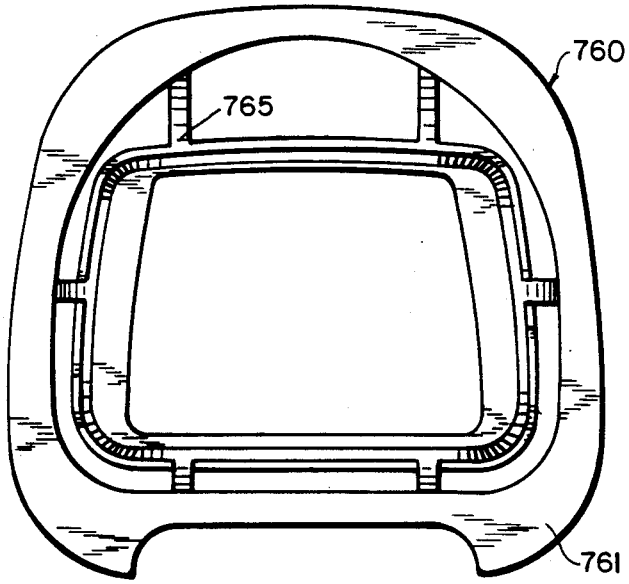
FIG. 31 is a rear view of the bag support.
Figure 32:
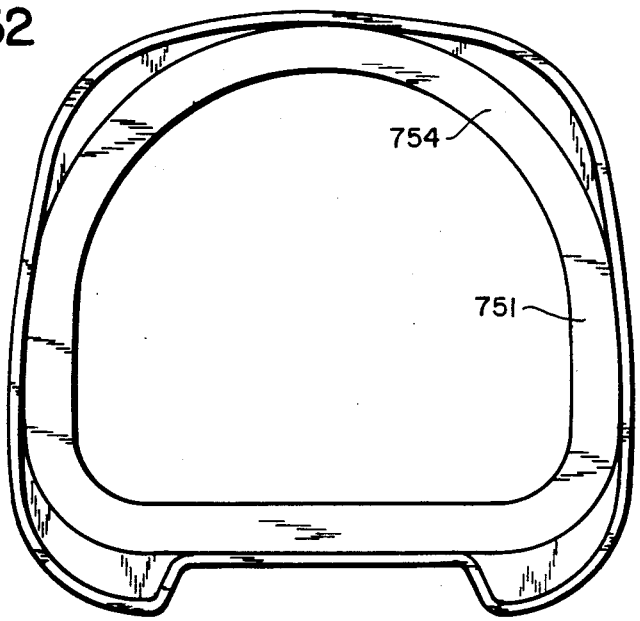
FIG. 32 is a rear view of the bag holder ring.
Figure 33:
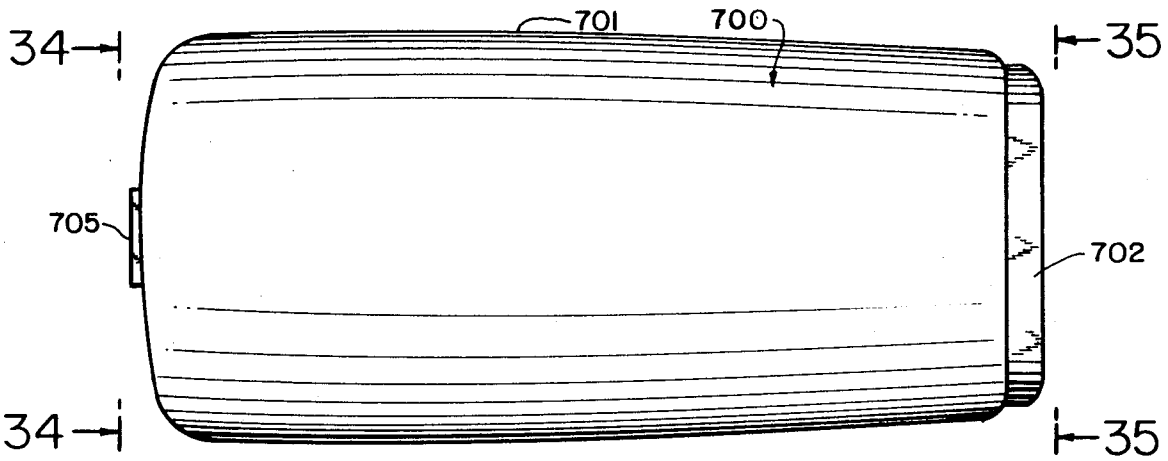
FIG. 33 is a top view of the canister.
Figure 35:
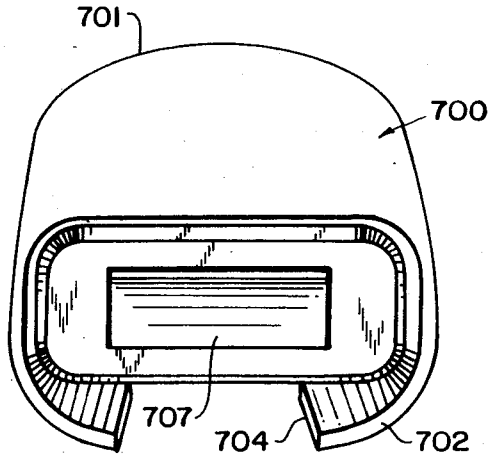
FIG. 35 is a front end view of the canister, as seen along the lines 35—35 of FIG. 33.
Figure 34:
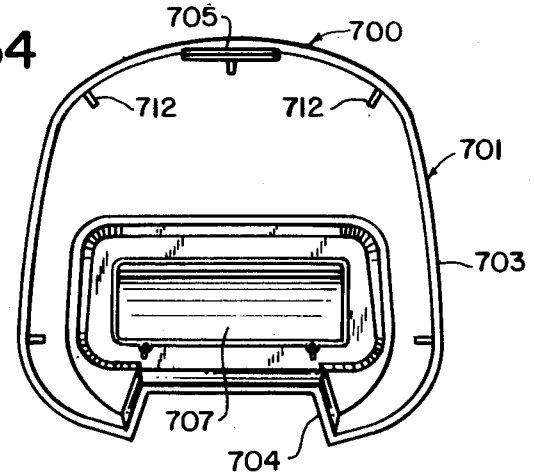
FIG. 34 is a rear end view of the canister, as seen along the lines 34—34 of FIG. 33.
Figure 36:
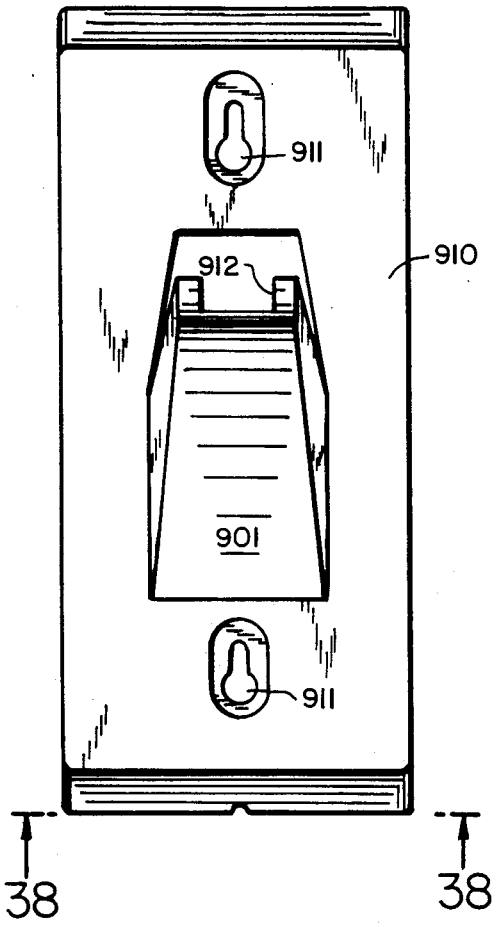
FIG. 36 is a front view of the charging mount of the vacuum cleaner.
Figure 37:
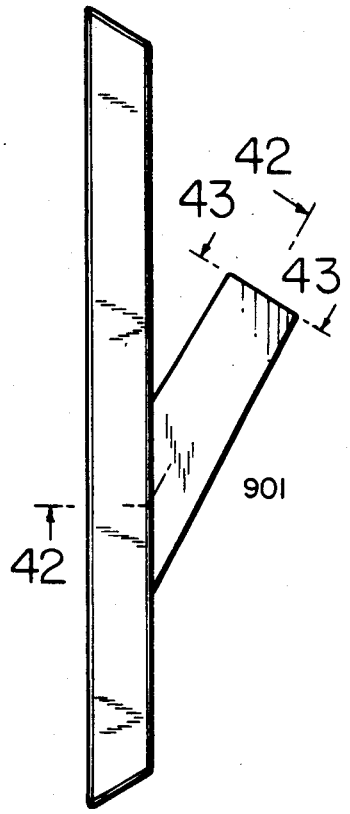
FIG. 37 is a side view of the charging mount.
Figure 38:
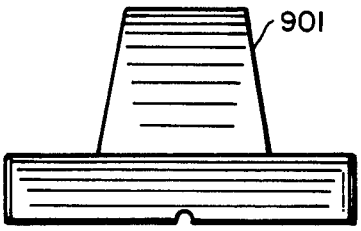
FIG. 38 is a bottom view of the charging mount.
Figure 39:
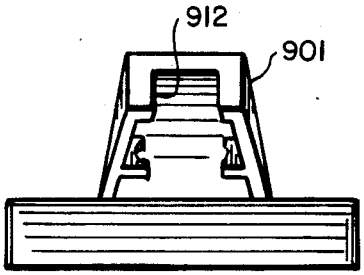
FIG. 39 is a top view of the charging mount housing.
Figure 40:
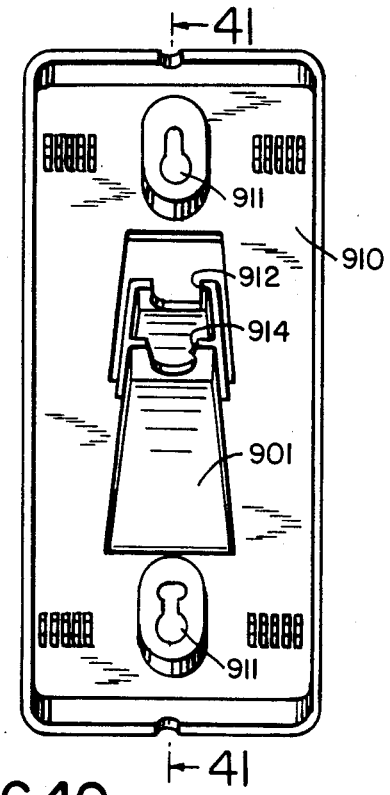
FIG. 40 is a rear view of the charging mount housing.

As illustrated more clearly in FIGS. 27 and 28, the forward end 702 of the canister communicates with the interior of the canister by way of a longitudinally extending port 706 which extends a short distance into the canister. A flap valve 707 is mounted on the rear end of the port 706. The flap valve may be comprised, for example, of a flexible plastic or rubber sheet affixed, for example, to the bottom of the rear of the port 706. The flap valve 707 permits flow of air rearwardly through the port 706 and into the canister, but inhibits the flow of air in the reverse direction.

The filter bag assembly 750 is comprised of a bag holding ring 751 and a filter bag 752. The holding ring 751 is shaped to fit within the front end 703 of the canister, and be supported against the front edges of 711 of longitudinally extending ribs 712, their front edges 711 being set back from the front edge 703. The holding ring 751 has a rearwardly extending flange 753 over which the front end of the filter bag 752 extends and is held by any conventional means. The bag 752 thus extends into the cannister 701. The ring 751 is sufficiently rigid to hold the bag 752, and has a flexible sealing lip 754 extending around its forward surface, to form a seal against the inclined surface 206 of the power assembly.

Figure 26:
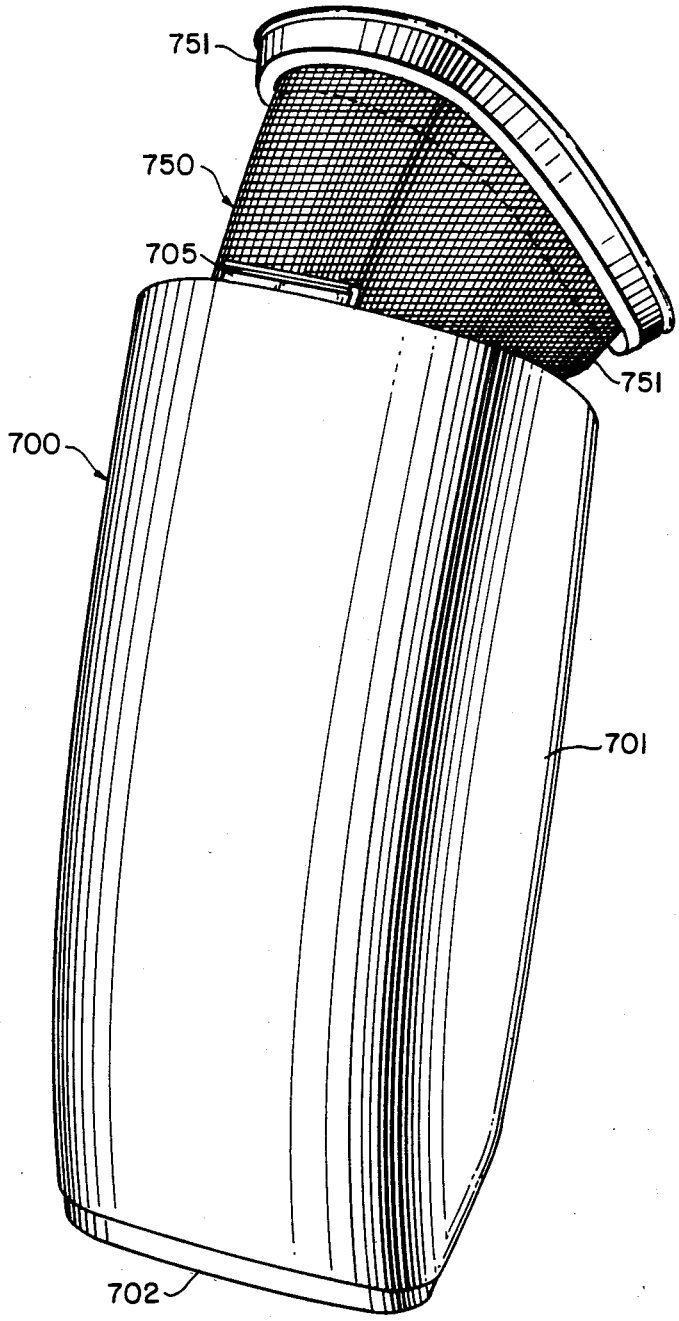
FIG. 26 is a perspective view of the filter assembly of the vacuum cleaner.

The holding ring 751, which may be of plastic or rubber material, further has a recess 755 adjacent its forward end for receiving and holding the forward rim 761 of the bag support 760, as illustrated in FIG. 44. The bag support 760 defines a forwardly extending cage 765, extending into the bag 752, to hold the shape of the bag, as illustrated for example in FIG. 44. The filter bag assembly 750 may be removed from the canister for cleaning, as illustrated in FIG. 26. Thus, in order to remove dirt that has accumulated on the front of the filter bag during use, the canister is first removed from the vacuum cleaner by releasing it by means of the catch 202, and pivoting it out and away from the vacuum cleaner. The filter bag assembly 750 is then withdrawn from the front of the canister along with the bag support 760 held therein, and the dirt then shaken from the outside of the bag and from the interior of the canister into a suitable waste receptacle. The bag assembly may then be rassembled in the canister, and the canister reassembled on the vacuum cleaner as discussed above.

The charging mount, for supporting the vacuum cleaner when not in use, while simultaneously recharging the batteries therein, is illustrated in FIGS. 36–43. The charging mount which may be formed of a molded plastic material, has a base 910 adapted to be mounted to a wall, for example by means of screw holes 911. The mounting projection 901 extends upwardly at an angle from the base, and is shaped to be received in the similarly inclinedmounting ressess 201 of the power assembly. The connector 905 is held within the mounting projection 901, as illustrated in FIG. 41, for example in a suitably shaped resses in an interior wall 914 of the mounting projection. The connector 905 is connected in conventional manner to the wall transformer 925 (FIG. 6) by way of cord 927.

An internal circuit that may be employed in the vacuum cleaner of the invention is illustrated in FIG. 45, wherein it is seen that the motor 208 is connected to the rechargeable battery 214 by way of the operating switch 211. The recharging terminals 216, to which the output of the recharging transformer 925 is applied, are connected to opposite terminals of the battery 214 by way of charging rectifier 230, so that the battery may be continually charged when the vacuum cleaner is mounted on the charging mount. The charging of the battery is indicated by the LED indicator 215, connected to the terminals 216 by way of the rectifier 241 and dropping resister 240.

While the invention has been disclosed and described with reference to a single embodiment, it is apparent that variations and modifications may be made therein, and is therefore intended in the following claims to cover each such variation and modification as falls within the true spirt and scope of the invention.

What is claimed is:

1. In a vacuum cleaner assembly comprising a hollow nozzle assembly, a vacuum pump, a filter, and means for directing air from said nozzle assembly to said pump by way of said filter bag, the improvement wherein said vacuum cleaner assembly further comprises a mounting frame, a mounting arrangement for mounting said pump and nozzle assembly in spaced apart relationship to said mounting frame, and said directing means comprises a canister removably mounted to said mounting frame between said nozzle assembly and pump and having a longitudinal recess extending along one edge thereof, said filter bag being removably held in said canister, said mounting frame extending in said recess and inhibiting relative rotation of said canister about its longitudinal axis.

2. The vacuum cleaner of claim 1 wherein said directing means further comprises a hollow mounting assembly mounted on said frame, and said nozzle assembly is pivotally mounted on said mounting assembly, whereby air from said nozzle assembly passes through said hollow mounting assembly.

3. In a vacuum cleaner assembly comprising a hollow nozzle assembly, a vacuum pump, a filter bag, and means for directing air from said nozzle assembly to said pump by way of said filter bag, the improvement wherein said vacuum cleaner assembly further comprises a mounting frame, a mounting arrangement for mounting said pump and nozzle assembly in spaced apart relationship to said mounting frame, and said directing means comprises a canister removably mounted to said mounting frame between said nozzle assembly and pump, said filter bag being removably held in said canister, said directing means further comprising a hollow mounting assembly mounted on said frame, said nozzle assembly being pivotally mounted on said mounting assembly, whereby air from said nozzle assembly passes through said hollow mounting assembly, one end of said canister being removably received in a recess in said hollow mounting assembly, and further comprising a power assembly housing containing said vacuum pump, and a latching arrangement on said power assembly housing positioned to releasably hold said canister to said mounting frame, whereby upon release of said latching arrangement said canister may be removed from said recess by rotating said end of said canister with respect to said mounting assembly.

4. A portable vacuum cleaner comprising a frame, a hollow mounting arrangement and a power assembly fixedly mounted in spaced apart relationship on said frame, said power assembly including a vacuum pump, a filter assembly including a canister having a longitudinal recess extending along one side thereof, said canister being removably fitted between said mounting arrangement and said power assembly with said frame extending in said recess whereby said vacuum pump draws air through said mounting arrangement means and canister to said vacuum pump when said canister is fitted between said mounting arrangement and power assembly, and a hollow nozzle mounted on said mounting arrangement.

5. The portable vacuum cleaner of claim 4 wherein said nozzle is mounted on said mounting arrangement for limited pivotal movement.

6. The portable vacuum cleaner of claim 4 wherein said mounting arrangement comprises a mounting cylinder having a duct extending transversely therethrough, and said nozzle is pivotally held on said mounting cylinder, whereby air from said nozzle is directed through said cylinder to said vacuum pump.

7. The portable vacuum cleaner of claim 6 wherein said nozzle is comprised of upper and lower nozzle sections fitted together around said mounting cylinder, and each having arcuate sealing surfaces engaging said mounting cylinder.

8. The portable vacuum cleaner of claim 4 wherein said frame comprises an elongated support, said mounting arrangement comprising a hollow element on one end of said elongated support, said power assembly comprising a power assembly housing on the other end of said elongated support.

9. The portable vacuum cleaner of claim 8 wherein said power assembly housing has an end facing said mounting arrangement that is inclined to the longitudinal direction of said elongated support and away from said mounting arrangement.

10. The portable vacuum cleaner of claim 9 wherein at least a portion of one end of said canister is removably received in a recess in the end of said mounting arrangement facing said power assembly and has an end face sealingly engaging said end of said power assembly.

11. The portable vacuum cleaner of claim 8 wherein one end of said canister longitudinally engages a recess in the end of said mounting arrangement facing said power assembly, further comprising a latching arrangement holding the other end of said canister to said power assembly.

12. The portable vacuum cleaner of claim 11 further comprising a filter bag removably held in said other end of said canister, said filter bag having a seal engaging said power assembly.

13. The portable vacuum cleaner of claim 12 wherein said canister further includes a flap valve mounted to inhibit flow of air in the direction away from said vacuum pump.

14. The portable vacuum cleaner of claim 4 wherein said hollow nozzle has a lower surface adapted to be drawn across a surface to be cleaned, and a recess extending transversely across said lower surface, said nozzle further having a duct extending from said recess to said hollow mounting arrangement.

15. The portable vacuum cleaner of claim 14 wherein said lower surface of said nozzle has front corners, and said recess extends adjacent said front corners.

16. The portable vacuum cleaner of claim 14 wherein wheels are mounted in said lower surface for engaging a surface to be cleaned.

17. The portable vacuum cleaner of claim 4 wherein said power assembly comprises a housing, a mounting recess in said housing for receiving a mounting projection to enable mounting said vacuum cleaner on a wall, said vacuum pump including a motor, a battery for energizing said motor, a charging circuit for charging said battery, and a connector in said recess and connected to said charging circuit for enabling charging of said battery.

18. In a vacuum cleaner assembly comprising a hollow nozzle assembly, a vacuum pump, a filter bag, and means for directing air from said nozzle assembly to said pump by way of said filter bag, the improvement wherein said vacuum cleaner assembly further comprises a mounting frame, a mounting arrangement for mounting said pump and nozzle assembly in spaced apart relationship to said mounting frame, said directing means comprising a canister removably mounted to said mounting frame between said nozzle assembly and pump, said filter bag being removably held in said canister, said nozzle assembly being pivotally mounted to said mounting arrangement and having a lower surface, a duct forming part of the directing means and extending centrally through said lower surface and communicating with said canister by way of said mounting assembly, at least one ground engaging wheel having a fixed axis and mounted forwardly of said duct, and at least one ground engaging wheel having a fixed axis and mounted rearwardly of said duct, the axis of pivoting of said nozzle being parallel to and in a vertical plane between the axis of the wheels, said nozzle assembly comprising upper and lower nozzle portions, said lower surface being the lower surface of said lower nozzle portion, said mounting arrangement comprising a mounting cylinder having a transversely extending port, said upper and lower nozzle portions having semi-cylindrical surfaces rotatably engaging said mounting cylinder for pivotally mounting said nozzle on said mounting cylinder with said duct communicating with said port.

19. A portable vacuum cleaner comprising a frame, a hollow mounting arrangement and a power assembly fixedly mounted in spaced apart relationship on said frame, said power assembly including a vacuum pump, a filter assembly including a canister removably fitted between said mounting assembly and said power assembly whereby said vacuum pump draws air through said mounting arrangement and canister to said vacuum pump when said canister is fitted between said mounting arrangement and power assembly, a hollow nozzle mounted on said mounting arrangement, said mounting arrangement having a rearwardly extending rim defining a recess for receiving the forward end of said canister, said power assembly having a forward surface for engaging the rear end of said canister that is inclined to the longitudinal axis of said cleaner, a latch mounted to releasably hold the rear end of said canister to said power assembly, whereby said canister may be removed from said vacuum cleaner by release of said latch and rotational movement of the canister in one direction with respect to said recess, and means inhibiting removal of said canister from said vacuum cleaner in all other directions.

* * * * *